US007480392B2

(12) United States Patent
Shin et al.

(10) Patent No.: US 7,480,392 B2
(45) Date of Patent: Jan. 20, 2009

(54) PLATE TYPE SPEAKER USING HORIZONTAL VIBRATION VOICE COIL

(76) Inventors: Joung-Youl Shin, Samsung Remian Apt. 103-1804, 414, Naeson-Dong, Uiwang 437-804 (KR); Byung-Wan Han, 401, Wooran Dilla, 1478-4 Seocho3-Dong, Seocho-Gu, Seoul 137-888 (KR)

( * ) Notice: Subject to any disclaimer, the term of this patent is extended or adjusted under 35 U.S.C. 154(b) by 363 days.

(21) Appl. No.: 10/596,214

(22) PCT Filed: Dec. 2, 2004

(86) PCT No.: PCT/KR2004/003157

§ 371 (c)(1),
(2), (4) Date: Jun. 2, 2006

(87) PCT Pub. No.: WO2005/055649

PCT Pub. Date: Jun. 16, 2005

(65) Prior Publication Data

US 2007/0165887 A1 Jul. 19, 2007

(30) Foreign Application Priority Data

Dec. 5, 2003 (KR) ..... 10-2003-008160

(51) Int. Cl.
*H04R 1/00* (2006.01)
*H04R 9/06* (2006.01)

(52) U.S. Cl. ..... 381/419; 381/398; 381/430

(58) Field of Classification Search ..... 381/152, 381/176, 398, 399, 401, 419, 421, 423, 430, 381/431; 181/161, 171, 173; 310/21, 29

See application file for complete search history.

(56) References Cited

U.S. PATENT DOCUMENTS

| | | | | |
|---|---|---|---|---|
| 1,827,919 | A * | 10/1931 | Van Wagenen | 381/419 |
| 6,810,126 | B2 * | 10/2004 | Levitsky | 381/431 |
| 2002/0146144 | A1 * | 10/2002 | Arnstein | 381/430 |
| 2003/0103642 | A1 * | 6/2003 | Kam | 381/431 |

FOREIGN PATENT DOCUMENTS

| | | |
|---|---|---|
| JP | 56-058398 | 5/1981 |
| JP | 58-162197 | 9/1983 |
| JP | 06-269089 | 9/1994 |
| JP | 2001-169389 | 6/2001 |

* cited by examiner

*Primary Examiner*—Suhan Ni
*Assistant Examiner*—Jesse A Elbin
(74) *Attorney, Agent, or Firm*—IPLA P.A.; James E. Bame

(57) ABSTRACT

The present invention relates to a plate type speaker adapted to radiate sound by transforming horizontal vibration for vibrating a side of a diaphragm into vertical vibration of the diaphragm. The plate type speaker of the present invention comprises a plate-shaped diaphragm for receiving horizontal vibration to generate vertical vibration; a base frame having a fixing portion to which one end of the diaphragm is coupled; a voice coil plate that has one end connected to the other end of the diaphragm, is mounted on the base frame to horizontally vibrate and has a voice coil wound on either or both of surfaces thereof, and a magnetic body that has opposite polarities at positions spaced apart by predetermined distances from top and bottom surfaces of the voice coil plate and is coupled to the base frame. According to the plate type speaker of the present invention, it is possible to manufacture a plate type speaker with a thickness reduced through transformation of vibration at a side of a diaphragm, which is caused by horizontal vibration of a voice coil plate, into vertical vibration of the diaphragm. Accordingly, the plate type speaker of the present invention can be easily applied to small appliances requiring an audio system, and it is also possible to manufacture plate type speakers in various forms with a plurality of diaphragms depending on the structure of a base frame.

9 Claims, 6 Drawing Sheets

【Fig. 1】
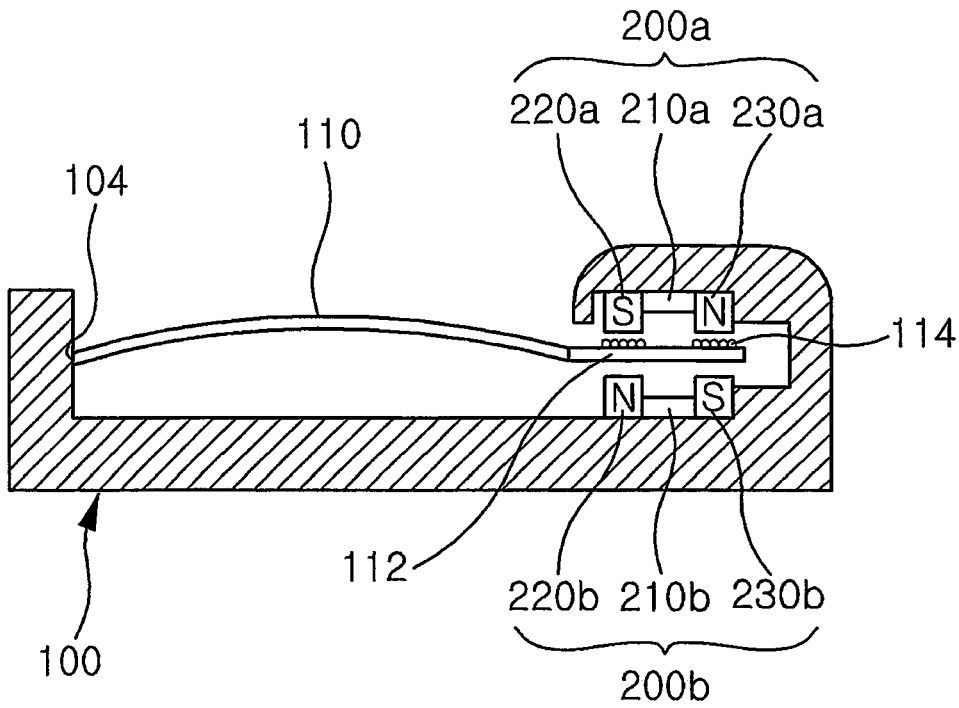
【Fig. 2】
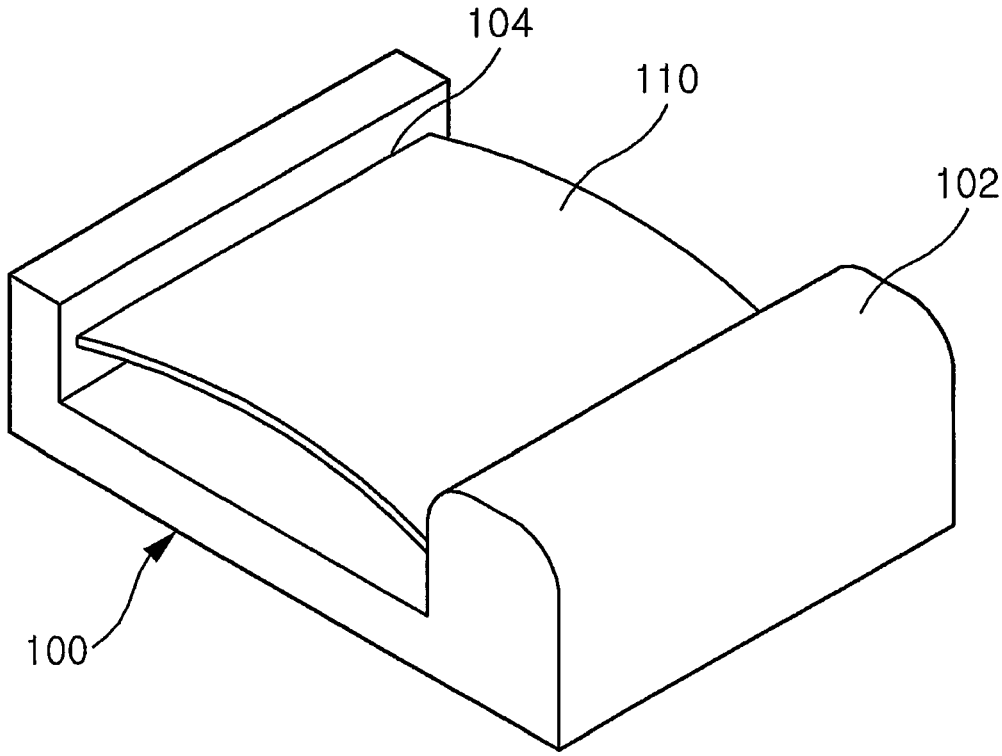

【Fig. 3】
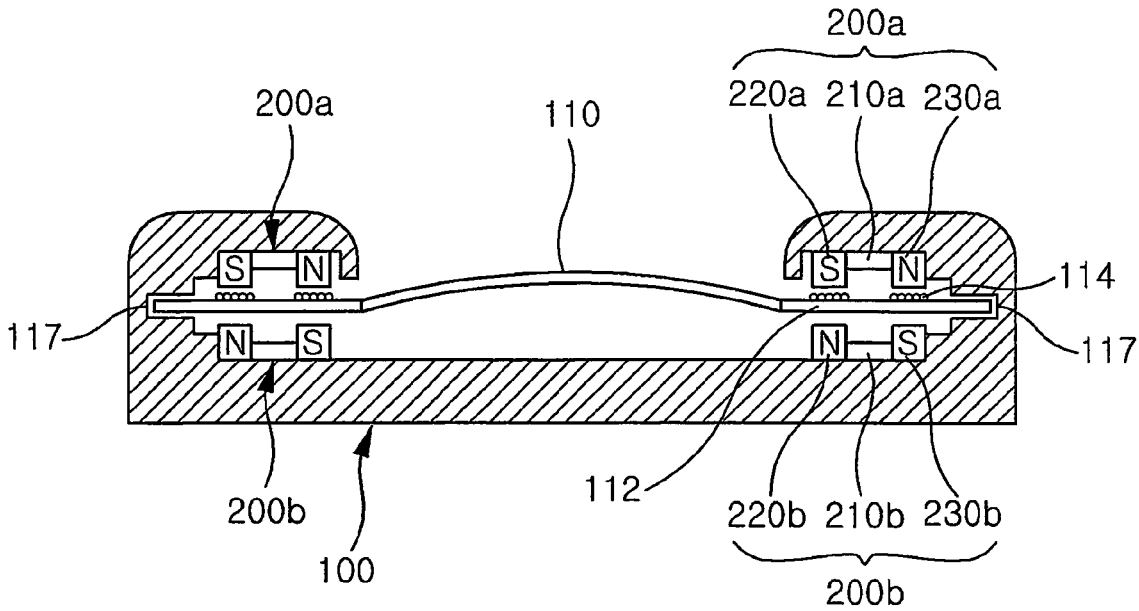
【Fig. 4】
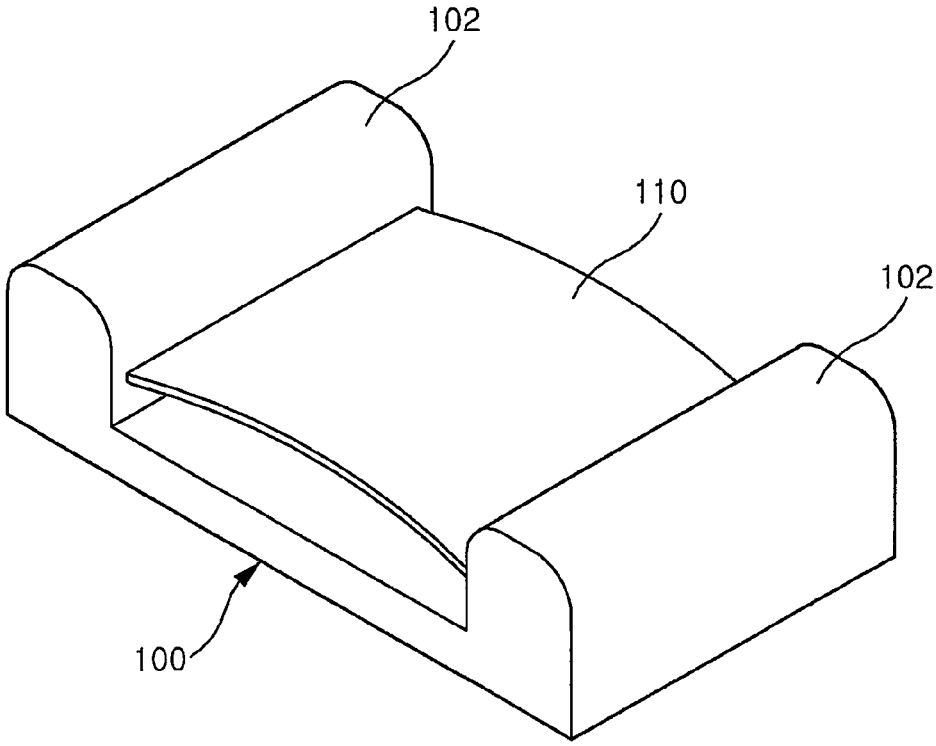

【Fig. 5】
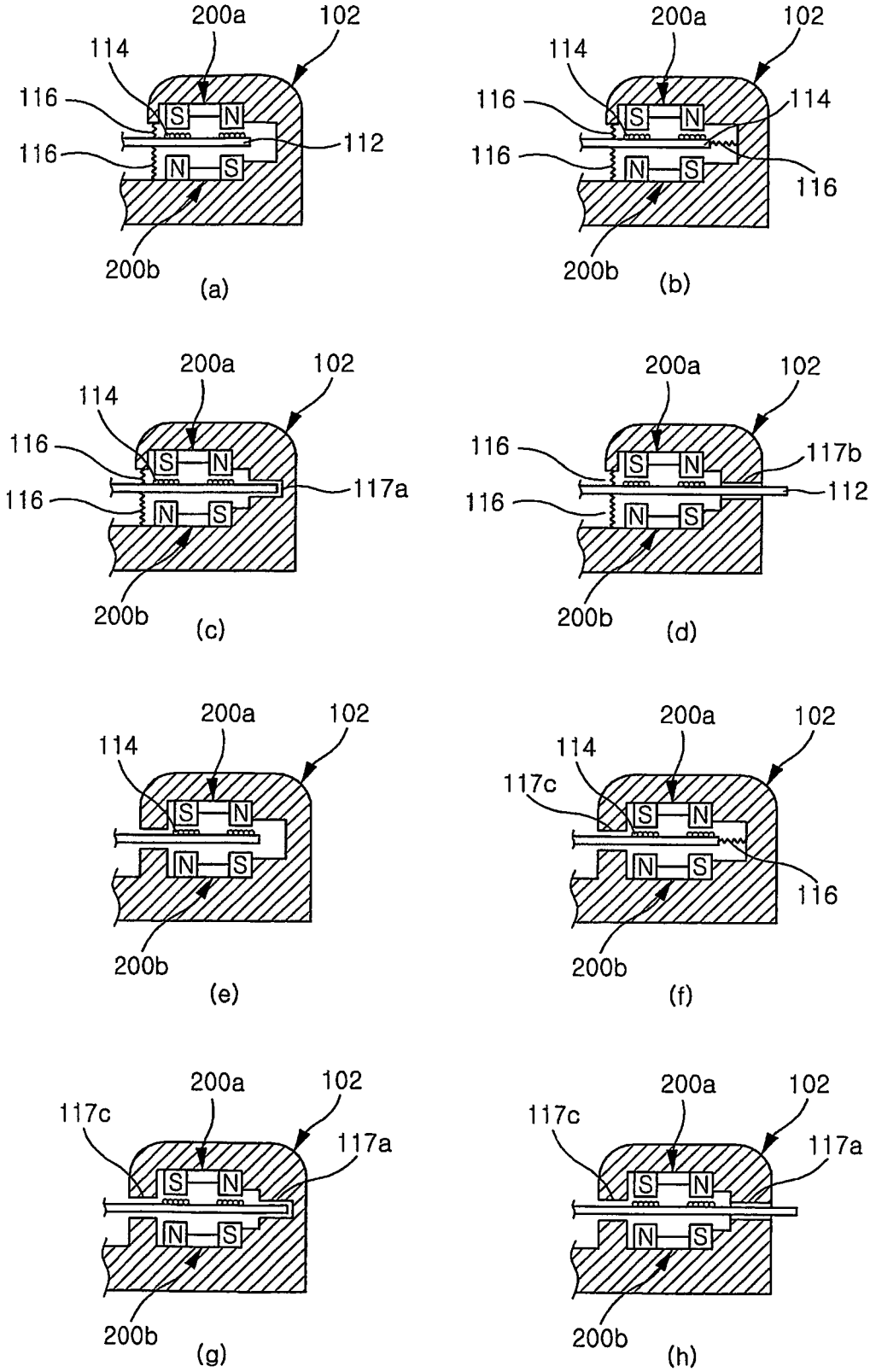

【Fig. 6】
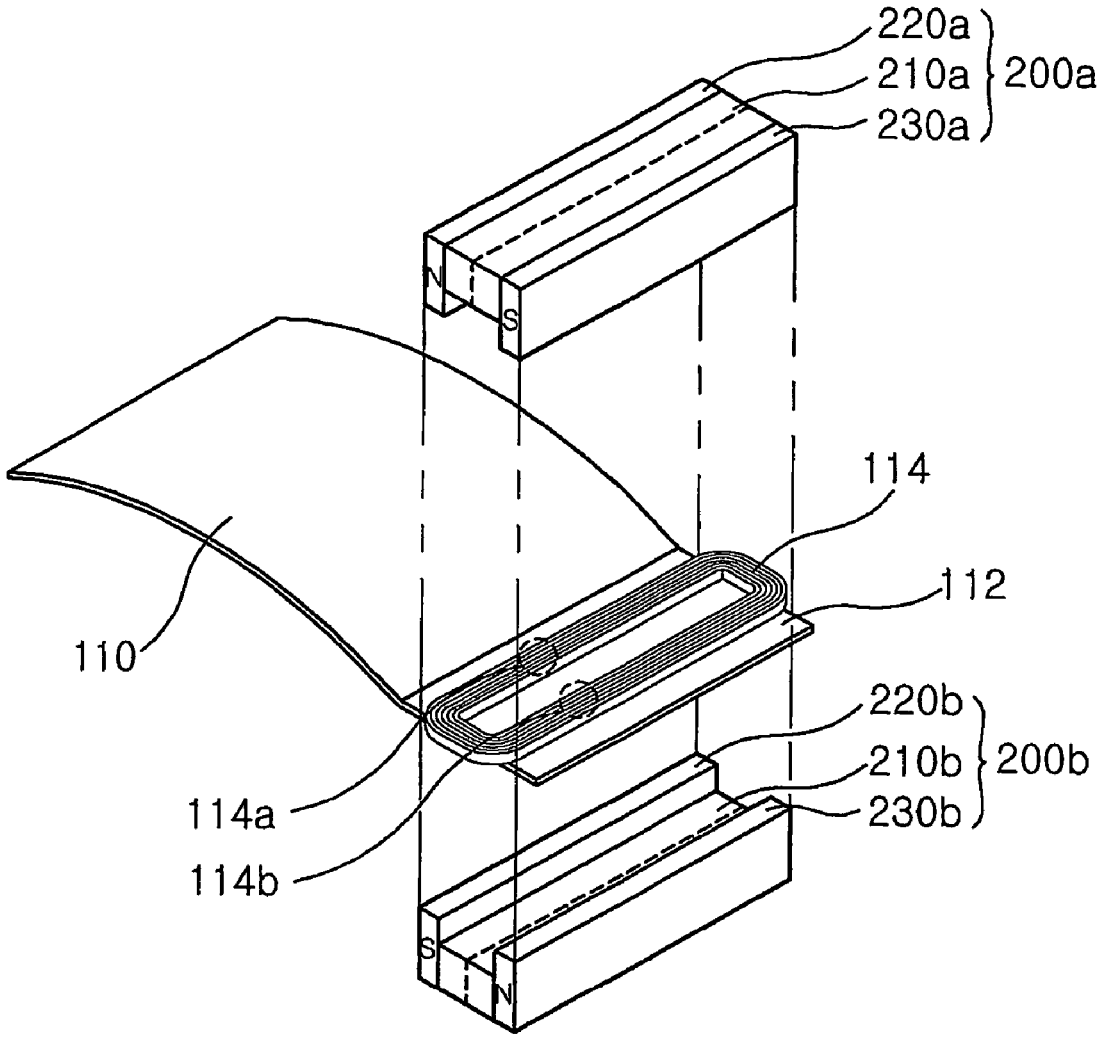

【Fig. 7】
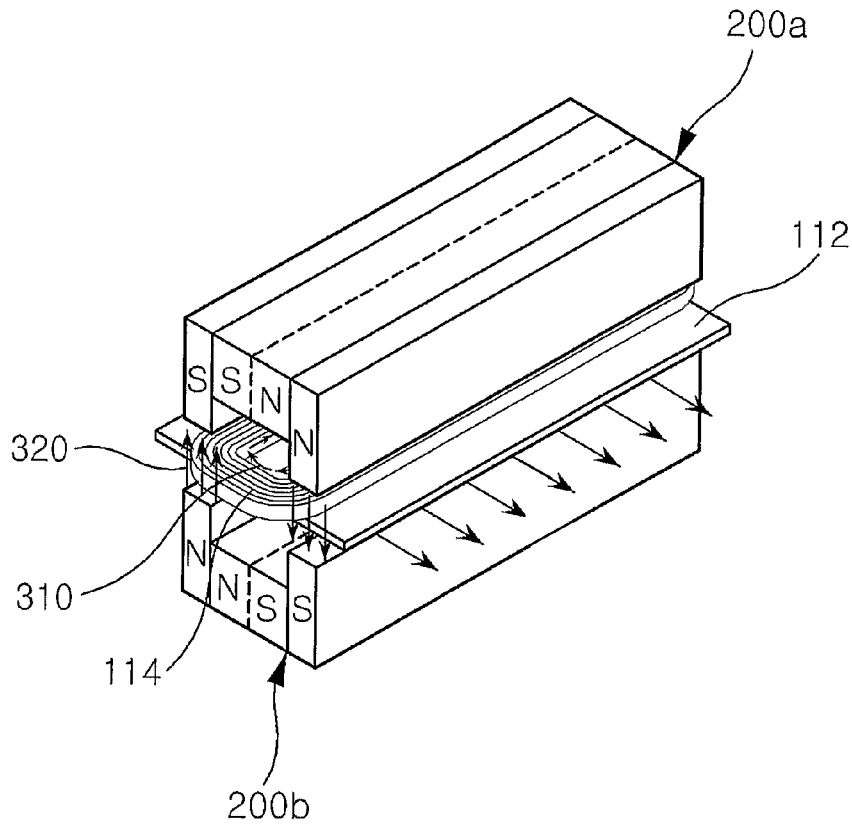
【Fig. 8】
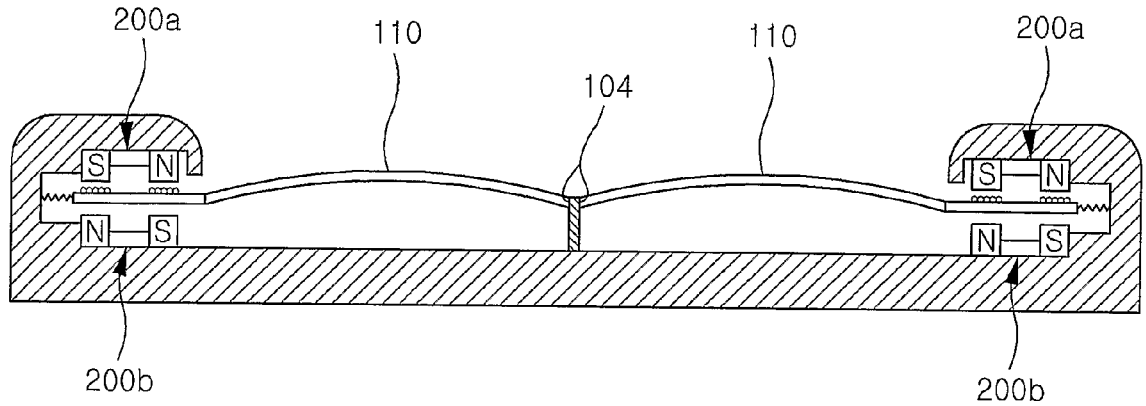

【Fig. 9】
Prior Art
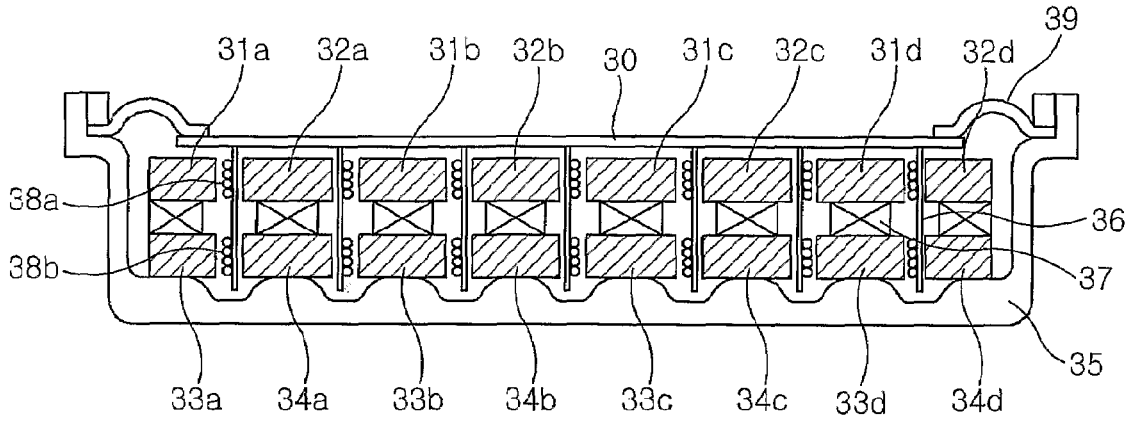
【Fig. 10】
Prior Art
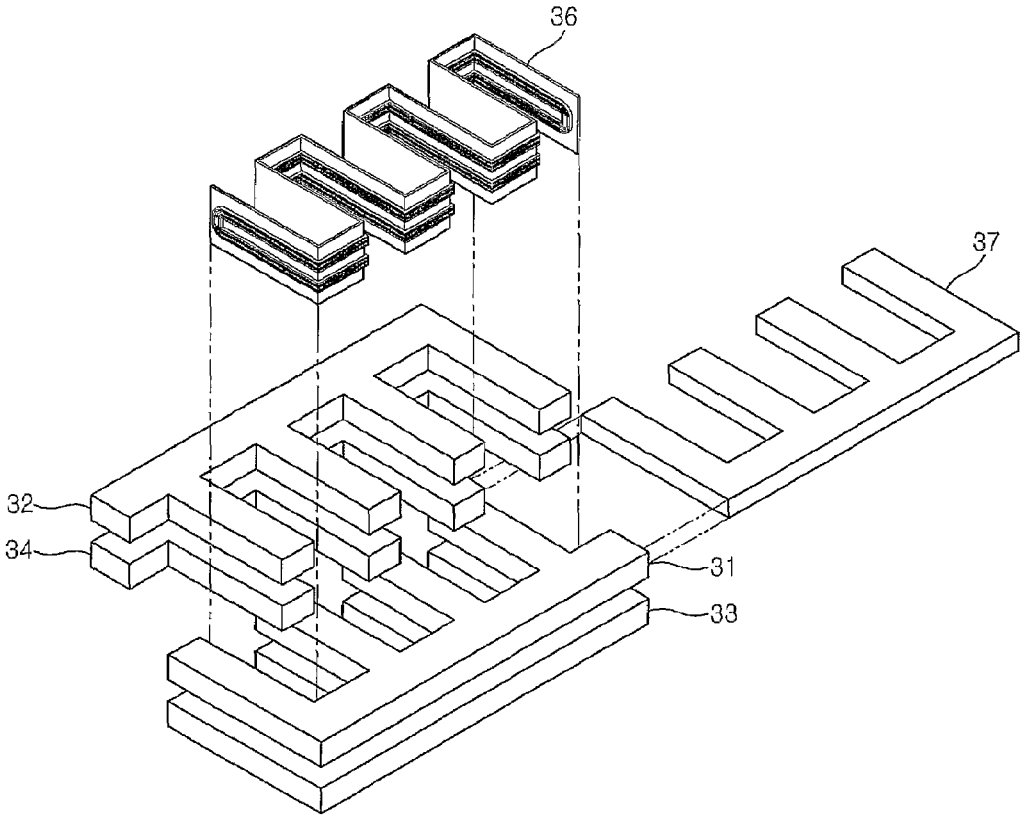

PLATE TYPE SPEAKER USING HORIZONTAL VIBRATION VOICE COIL

TECHNICAL FIELD

The present invention relates to a plate type speaker adapted to radiate sound by transforming horizontal vibration of a side of a diaphragm into vertical vibration of the diaphragm.

BACKGROUND ART

A speaker is a device for radiating sound by generating compression-rarefaction waves in the air through transformation of electrical signals into vibration of a diaphragm. The principle of vibration of a diaphragm included in a speaker uses a phenomenon in which a low- or high-pitched sound is generated by vibrating the diaphragm at a low or high frequency using Lorentz force caused by a current flowing through a voice coil placed in a magnetic field. As the amplitude increases even at a frequency, the sound gets louder due to increased sound pressure.

Speakers include cone type speakers, plate type speakers, dome type speakers, horn type speakers, and the like. Among them, the plate type speakers are advantageous over other type speakers in that they can be manufactured in compact sizes by attaching voice coil plates directly to flat diaphragms.

FIG. 9 is a schematic sectional view of a conventional plate type speaker, and FIG. 10 is an exploded perspective view showing a coupling structure of a voice coil, permanent magnets and plates employed in the conventional plate type speaker.

As shown in FIGS. 9 and 10, a flat coil plate 36 with a top end to which a flat diaphragm 30 is vertically fixed is inserted into an assembly of upper plates 31*a*, 31*b*, 31*c*, 31*d*, 32*a*, 32*b*, 32*c* and 32*d*, lower plates 33*a*, 33*b*, 33*c*, 33*d*, 34*a*, 34*b*, 34*c* and 34*d*, and permanent magnets 37 fixed therebetween. The assembly of permanent magnets and upper and lower plates is fixed to a base frame 35. Then, an edge 39 is bonded to the periphery of the flat diaphragm 30 and secured by a guide ring.

An electric current generated at a speaker driving circuit is supplied to a voice coil 38 fixed at the coil plate 36 to produce a magnetic field at the voice coil 38. The magnetic field cooperates with a facing magnetic field generated from the polarity of the permanent magnet-plate assembly, thereby generating a force that vibrates the coil plate 36 and the flat diaphragm 30 fixed thereto. Consequently, the vibration of the diaphragm 30 causes sound to radiate outside.

However, in the conventional plate type speaker constructed as above, there are limitations on manufacture of slim speakers suitable for small appliances since the coil plate 36 is attached to a bottom end of the diaphragm 30 and the assembly of permanent magnets and upper and lower plates is formed and placed below the diaphragm 30.

DISCLOSURE

Technical Problem

The present invention is conceived to solve the aforementioned problems. An object of a present invention is to provide a plate type speaker with a horizontally vibrating voice coil, wherein a voice coil plate is coupled to a side of a diaphragm with a predetermined upward curvature to vibrate the side of the diaphragm and the vibration of the side of the diaphragm is transformed into vertical vibration of the diaphragm to generate acoustic waves, thereby being easily applicable to a small and slim device requiring an audio system.

Technical Solution

According to an aspect of the present invention for achieving the object, there is provided a plate type speaker, comprising a plate-shaped diaphragm for receiving horizontal vibration to generate vertical vibration; a base frame having a fixing portion to which one end of the diaphragm is coupled; a voice coil plate that has one end connected to the other end of the diaphragm, is mounted on the base frame to horizontally vibrate and has a voice coil wound on either or both of surfaces thereof; and a magnetic body that has opposite polarities at positions spaced apart by predetermined distances from top and bottom surfaces of the voice coil plate and is coupled to the base frame.

According to another aspect of the present invention for achieving the object, there is provided a plate type speaker, comprising a plate-shaped diaphragm for receiving horizontal vibration to generate vertical vibration; a base frame; voice coil plates each of which has one end connected to one of opposite ends of the diaphragm, is mounted on the base frame to horizontally vibrate and has a voice coil wound on either or both of surfaces thereof; and magnetic bodies that have opposite polarities at positions spaced apart by predetermined distances from top and bottom surfaces of the corresponding one of the voice coil plates and are coupled to the base frame.

In the plate type speaker, the magnetic body may further comprise opposite polarities at lateral side ends thereof horizontally spaced apart by a predetermined distance from each other at the positions spaced apart by the predetermined distances from the top and bottom surfaces of the voice coil plate. At this time, the magnetic body preferably comprises assemblies each of which includes a permanent magnet with opposite polarities at left and right sides thereof, a left plate coupled to the left side of the permanent magnet, and a right plate coupled to the right side of the permanent magnet, wherein the assemblies are arranged at the positions spaced apart by the predetermined distances from the top and bottom surfaces of the voice coil plate. The voice coil wound on either or both of the surfaces of the voice coil plate may have both opposite ends located at left and right sides of the magnetic body.

The diaphragm may be upwardly convexly curved.

The base frame may comprise a supporting groove for supporting the other end of the voice coil plate.

The base frame may comprise at least one supporting groove bored through the base frame, in order to support at least one portion of the voice coil plate on the left or right side or both sides of the voice coil formed on the voice coil plate.

The plate type speaker may further comprise a supporting member having both ends connected to the voice coil plate and the base frame, respectively, to support the voice coil plate.

BRIEF DESCRIPTION OF DRAWINGS

FIG. 1 is a sectional view of a plate type speaker with a horizontally vibrating voice coil according to a first embodiment of the present invention.

FIG. 2 is a perspective view of the plate type speaker with the horizontally vibrating voice coil according to the first embodiment of the present invention.

FIG. 3 is a sectional view of a plate type speaker with a horizontally vibrating voice coil according to a second embodiment of the present invention.

FIG. 4 is a perspective view of the plate type speaker with the horizontally vibrating voice coil according to the second embodiment of the present invention.

FIG. 5 illustrates how to support the plate type speaker with the horizontally vibrating voice coil according to the present invention within a base frame by means of a variety of available means.

FIG. 6 is an exploded perspective view showing structures of a diaphragm, the voice coil plate and magnetic bodies in the plate type speaker with the horizontally vibrating voice coil according to the present invention.

FIG. 7 illustrates an operational principle of the diaphragm employed in the plate type speaker with the horizontally vibrating voice coil according to the present invention.

FIG. 8 shows a modified plate type speaker with a horizontally vibrating voice coil according to another embodiment of the present invention.

FIG. 9 is a schematic sectional view of a conventional plate type speaker.

FIG. 10 is an exploded perspective view showing a coupling structure of a voice coil, permanent magnets and plates employed in the conventional plate type speaker.

BEST MODE FOR CARRYING OUT THE INVENTION

Hereinafter, preferred embodiments of a plate type speaker with a horizontally vibrating voice coil according to the present invention will be described in detail with reference to the accompanying drawings.

FIG. 1 is a sectional view of a plate type speaker with a horizontally vibrating voice coil according to a first embodiment of the present invention. As shown in the figure, a diaphragm 110 is coupled at a side thereof to a fixing portion 104 formed in a base frame 100, and the other side of the diaphragm 110 opposite to the side thereof coupled to the fixing portion 104 has a voice coil plate 112 coupled thereto such that the voice coil plate can vibrate horizontally. The voice coil plate 112 is inserted between first and second magnetic bodies 200*a* and 200*b* that are arranged on the base frame 100 to be spaced apart by predetermined distances from each other.

The diaphragm 110, which vertically vibrates as the side thereof is vibrated due to the horizontal vibration of the voice coil plate 112, may be made in the form of a flat plate but it is formed to be upwardly convex so that sound can smoothly radiate in the air.

FIG. 2 is a perspective view of the plate type speaker with the horizontally vibrating voice coil according to the first embodiment of the present invention. As shown in the figure, the plate type speaker with the horizontally vibrating voice coil according to the present invention is constructed such that the other side of the diaphragm 110 with the voice coil plate 112 coupled thereto is inserted into and installed within a magnetic body portion 102 in which the magnetic bodies 200 are installed, and the side of the diaphragm 110 is coupled to the fixing portion 104 formed in the base frame 100. The magnetic body portion 102 is a portion in which the first and second magnet bodies shown in FIG. 1 are placed. The fixing portion 104 and the side of the diaphragm 110 may be bonded to each other with an adhesive such as glue. Alternatively, the fixing portion is a portion formed such as by providing the base frame 100 with a groove which the side of the diaphragm 110 is inserted into and coupled to.

When an electric signal is input into a voice coil 114 wound on the voice coil plate 112, which is inserted between the first and second magnet bodies 200*a* and 200*b* provided in the magnetic body portion 102, the voice coil plate 112 vibrates horizontally according to the Fleming's left-hand rule and the vibration of the voice coil plate 112 is transmitted to the diaphragm 110. Then, the diaphragm 110 vibrates vertically to radiate sound in the air.

FIG. 3 is a sectional view of a plate type speaker with a horizontally vibrating voice coil according to a second embodiment of the present invention.

As shown in the figure, both first and second magnetic bodies 200*a* and 200*b* are installed at each of both sides of a base frame 100 to be symmetrically arranged with respect to the center of a diaphragm 110. Then, it is possible to construct a plate type speaker with horizontally vibrating voice coils, which has a single diaphragm driven by the four magnetic bodies 200. Voice coil plates 112 are connected to the both sides of the diaphragm 110 so that the voice coil plates 112 can horizontally vibrate, and each of the voice coil plates is introduced between the first and second magnetic bodies 200*a* and 200*b* installed at each of the both sides of the base frame 100 and inserted into an inner supporting groove 117 formed in the base frame 100.

In the plate type speaker with the horizontally vibrating voice coil, which has the single diaphragm 110 driven by the four magnetic bodies 200, when an electric signal is input into the voice coils 114 wound on the two voice coil plates 112 each of which is interposed between the first and second magnetic bodies 200*a* and 200*b*, the voice coil plates 112 vibrate horizontally according to the Fleming's left-hand rule so that forces are exerted toward the center of the diaphragm, and the vibration of the voice coil plates 112 is transmitted to the diaphragm 110 to radiate sound in the air. The reason why the polarities of the magnetic bodies 200 and the direction of the electric current supplied to the coils are set such that the forces are simultaneously exerted toward the center of the diaphragm 110 from the voice coil plates 112 coupled to the both sides of the diaphragm 110 to cause the diaphragm 110 to vertically vibrate by means of a resultant force obtained from the forces generated at the both sides of the diaphragm 110. The inner supporting grooves 117 are portions that are formed since the plate type speaker of the second embodiment does not include the fixing portion 104 where the side of the diaphragm 110 is fixed to the base frame 100 in the plate type speaker of the first embodiment, and they serve as means for stably supporting the diaphragm 110 in the base frame 100.

Further, the diaphragm 110, which vertically vibrates as the sides thereof are vibrated due to the horizontal vibration of the voice coil plates 112, may be made in the form of a flat plate but it is formed to be upwardly convex so that sound can smoothly radiate in the air.

FIG. 4 is a perspective view of the plate type speaker with the horizontally vibrating voice coil according to the second embodiment of the present invention.

The plate type speaker with the horizontally vibrating voice coil according to the second embodiment has a laterally symmetric shape in which the both sides of the diaphragm 110 with the voice coil plates 112 coupled thereto are inserted into the magnetic body portions 102 with the magnetic bodies 200 installed therein at the both lateral sides of the base frame 100.

It will be understood by those skilled in the art that the configuration of the speaker according to the present invention is not limited to those of the speakers according to the first and second embodiments, and various modifications can be made thereto.

FIG. 5 illustrates how to support the plate type speaker with the horizontally vibrating voice coil according to the present invention within the base frame by means of a variety of available means.

The plate type speaker with the horizontally vibrating voice coil according to the present invention employs a principle in which the vibration of the side of the diaphragm 110 caused by the horizontal vibration of the voice coil plate 112 is transferred into the vertical vibration of the diaphragm 110. Therefore, both a horizontal force causing the horizontal vibration and a vertical force causing the vertical vibration are exerted as a resultant force thereof on the voice coil plate 112. Thus, upon driving of the speaker, it is substantially difficult to horizontally maintain the voice coil plate 112 to be spaced apart by predetermined distances from the first magnetic body 200*a* installed at an upper portion in the base frame 100 and the second magnetic body 200*b* installed at a lower portion in the base frame 100. Accordingly, the voice coil plate 112 is also influenced by the vertical vibration.

As shown in the figure, methods of minimizing the influence of the vertical vibration include various methods such as formation of a supporting groove 117 in the base frame, addition of a supporting member 116, or combination of both the supporting groove 117 and the supporting member 116. Here, FIG. 5(*a*) shows a case where top and bottom surfaces of the voice coil plate 112 are connected to the base frame 100 via supporting members 116. At this time, the supporting member 116 intends to mean all available means including springs, rubber pads, corrugated clothes and the like, and serves to restrain the voice coil plate 112 to keep horizontality when the voice coil plate 112 horizontally vibrates.

Moreover, FIGS. 5(*b*), 5(*c*) and 5(*d*) show cases where means for more actively keeping the voice coil plate 112 from vertically vibrating by supplementing the method of FIG. 5(*a*) are further provided. Here, FIG. 5(*b*) shows a case where supporting members 116 are provided to be connected to the base frame 100 at three portions: the top and bottom surfaces of the voice coil plate 112 and a side thereof opposite to the coupled side of the diaphragm 110. FIG. 5(*c*) illustrates a method in which supporting members 116 provided on the top and bottom surfaces of the voice coil plate 112 are connected to the base frame 100 and the voice coil plate 112 is inserted into and slid in the supporting groove 117*a* formed in the base frame 100, thereby restraining the vertical vibration of the voice coil plate 112. FIG. 5(*d*) shows a method in which supporting members 116 provided on the top and bottom surfaces of the voice coil plate 112 are connected to the base frame 100 and the voice coil plate 112 is inserted into and slid in an outer supporting groove 117*b* formed to be bored through the opposite side of the base frame 100, thereby restraining the vertical vibration of the voice coil plate 112.

FIG. 5(*e*) shows a case where, instead of the supporting members 116 provided on the top and bottom surfaces of the voice coil plate to restrain the vertical vibration thereof, a front supporting hole 117*c* enabling application of a restraint method using sliding movement is provided in the vicinity of a portion of the base frame 100 where the diaphragm 110 and the voice coil plate 112 are coupled. FIGS. 5(*f*), 5(*g*) and 5(*h*) show cases where means for more actively keeping the voice coil plate 112 from vertically vibrating by supplementing the method of FIG. 5(*e*) are further provided. FIG. 5(*f*) shows a case where the front supporting groove 117*c* is combined with an additional supporting member 116 for connecting the voice coil plate 112 to the base frame 100 at the side opposite to the coupled side of the diaphragm 110. FIG. 5(*g*) shows a method in which the front supporting groove 117*c* is combined with the inner supporting groove 117*a* such that the voice coil plate 112 can be slid along the supporting grooves at both sides, thereby restraining the vertical vibration of the voice coil plate 112. FIG. 5(*h*) shows a method in which the front supporting groove 117*c* is combined with the outer supporting groove 117*b* formed to be bored through the opposite side of the base frame 100 such that the voice coil plate 112 can be slid along the supporting grooves at both sides, thereby restraining the vertical vibration of the voice coil plate 112.

FIG. 6 is an exploded perspective view showing structures of the diaphragm, the voice coil plate and the magnetic bodies in the plate type speaker with the horizontally vibrating voice coil according to the present invention.

As shown in the figure, a voice coil 114 wound in the form of a track having a pair of upper and lower ends 114*a* and 114*b* is attached to the voice coil plate 112 perpendicularly to the direction of vibration of the voice coil plate 112. One side of the voice coil plate 112 is connected to one side of the diaphragm 110. The magnetic bodies 200 each of which is constructed to have opposite polarities at both lateral sides thereof are arranged to be spaced apart by predetermined distances from the top and bottom surfaces of the voice coil plate 112 such that the polarities of the facing sides of the magnetic bodies are opposite to each other.

In this embodiment, the first magnetic body 200*a* installed to be spaced apart from the top surface of the voice coil plate 112 on the base frame 100 comprises a first left plate 220*a* with N polarity coupled to a left side of a first permanent magnet 210*a* and a first right plate 230*a* with S polarity coupled to a right side of the first permanent magnet 210*a*. The second magnetic body 200*b* installed to be spaced apart from the bottom surface of the voice coil plate 112 on the base frame 100 comprises a second left plate 220*b* with S polarity coupled to a left side of a second permanent magnet 210*b* and a second right plate 230*b* with N polarity coupled to a right side of the second permanent magnet 210*b*.

The reason why the first and second magnetic bodies 200*a* and 200*b* are installed to be spaced apart from the top and bottom surfaces of the voice coil plate 112 such that the facing polarities are opposite to each other is as follows. When electrical current flows in the wound voice coil 114 attached to the voice coil plate 112, the directions of the current flowing at the upper and lower ends 114*a* and 114*b* of the voice coil 114 become opposite directions. Thus, this is because the voice coil plate 112 can move in a direction to vibrate the diaphragm 110 only when the direction of a magnetic field generated by the first left plate 220*a* and the second left plate 220*b* corresponding to the upper end 114*a* of the voice coil 114 should be opposite to that of a magnetic field generated by the first right plate 220*b* and the second right plate 230*b* corresponding to the lower end 114*b* of the voice coil 114.

FIG. 7 illustrates an operational principle of the diaphragm employed in the plate type speaker with the horizontally vibrating voice coil according to the present invention.

The Fleming's left-hand rule will be explained to clarify the relationship between the voice coil plate 112 and the magnetic body 200 illustrated in FIG. 6. According to the direction 320 of the magnetic field generated at the left and right plates of the first and second magnetic bodies 200*a* and 200*b* and the direction 310 of the current flowing in the voice coil 114, a force is produced in the right direction. According to the magnitude and direction of the current, the diaphragm 110 vibrates with various amplitude and periods to output sound outward.

FIG. 8 shows a modified plate type speaker with a horizontally vibrating voice coil according to another embodiment of the present invention.

As shown in the figure, when a base frame 100 is constructed to have two fixing portions 104 at the center thereof and four magnetic bodies 200 installed at both lateral sides, it is possible to construct a plate type speaker with a horizontally vibrating voice coil, which has two diaphragms 110 attached to corresponding right and left sides of the fixing portions 104. Such structural modification is to produce stereo sound, to output higher power, or the like. In addition to the aforementioned change, various configurations can be implemented according to the shape of the base frame 100, the numbers of the magnetic bodies 200 and the diaphragms 110, and the like.

Although the present invention has been described in detail in connection with the preferred embodiments, the scope of the present invention is not limited to the specific embodiments but should be construed based on the appended claims. Further, it will be understood by those skilled in the art that various modifications and changes can be made without departing from the scope of the present invention.

For example, a plate type speaker of the present invention may comprise only a single magnetic body. In this case, the magnetic body may be variously configured such that opposite polarities of the magnetic body faces each other with a predetermined gap therebetween. At this time, contrary to the illustrated embodiments, the polarities are provided only at top and bottom surfaces of one side of a voice coil plate. Further, only a portion of the voice coil plate, which corresponds to one of both ends of the voice coil plate where a voice coil is formed horizontally, may be inserted between the opposite polarities that face each other. Moreover, the voice coil plate may be formed with a through-hole so that a voice coil can be wound on one side of the voice coil plate and then wound the other side of the voice coil plate after passing through the through-hole.

INDUSTRIAL APPLICABILITY

According to the plate type speaker of the present invention, it is possible to manufacture a plate type speaker with a thickness reduced through transformation of vibration at a side of a diaphragm, which is caused by horizontal vibration of a voice coil plate, into vertical vibration of the diaphragm. Accordingly, the plate type speaker of the present invention can be easily applied to small appliances requiring an audio system, and it is also possible to manufacture plate type speakers in various forms with a plurality of diaphragms depending on the structure of a base frame.

What is claimed is:

1. A plate type speaker, comprising:

a plate-shaped diaphragm for receiving horizontal vibration to generate vertical vibration;

a base frame having a fixing portion to which one end of the diaphragm is coupled;

a voice coil plate having one end connected to the other end of the diaphragm, said voice coil plate being mounted on the base frame to horizontally vibrate and having a voice coil wound on either or both of surfaces thereof; and a magnetic body having opposite polarities at positions spaced apart by predetermined distances from top and bottom surfaces of the voice coil plate, said magnetic body being coupled to the base frame.

2. A plate type speaker, comprising:

a plate-shaped diaphragm for receiving horizontal vibration to generate vertical vibration;

a base frame;

voice coil plates, each of said voice coil plates having one end connected to one of opposite ends of the diaphragm, each of said voice coil plates being mounted on the base frame to horizontally vibrate and having a voice coil wound on either or both of surfaces thereof; and magnetic bodies having opposite polarities at positions spaced apart by predetermined distances from top and bottom surfaces of the corresponding one of the voice coil plates, said magnetic bodies being coupled to the base frame.

3. The plate type speaker as claimed in claim 1, wherein the magnetic body further comprises opposite polarities at lateral side ends thereof horizontally spaced apart by a predetermined distance from each other at the positions spaced apart by the predetermined distances from the top and bottom surfaces of the voice coil plate.

4. The plate type speaker as claimed in claim 3, wherein the magnetic body comprises assemblies each of which includes:

a permanent magnet with opposite polarities at left and right sides thereof;

a left plate coupled to the left side of the permanent magnet; and a right plate coupled to the right side of the permanent magnet, wherein the assemblies are arranged at the positions spaced apart by the predetermined distances from the top and bottom surfaces of the voice coil plate.

5. The plate type speaker as claimed in claim 3, wherein the voice coil wound on either or both of the surfaces of the voice coil plate has both opposite ends located at left and right sides of the magnetic body.

6. The plate type speaker as claimed in claim 1, wherein the diaphragm is upwardly convexly curved.

7. The plate type speaker as claimed in claim 1, the base frame comprises a supporting groove for supporting the other end of the voice coil plate.

8. The plate type speaker as claimed in claim 1, wherein the base frame comprises at least one supporting groove bored through the base frame, in order to support at least one portion of the voice coil plate on the left or right side or both sides of the voice coil formed on the voice coil plate.

9. The plate type speaker as claimed in claim 1, further comprising a supporting member having both ends connected to the voice coil plate and the base frame, respectively, to support the voice coil plate.

* * * * *